US006038416A

United States Patent [19]

Okano et al.

[11] Patent Number: 6,038,416

[45] Date of Patent: Mar. 14, 2000

[54] DEVELOPING APPARATUS AND IMAGE FORMING APPARATUS HAVING THE SAME

[75] Inventors: Tadashi Okano, Hitachi; Masahiko Saito, Kitaibaraki; Isamu Terashima, Hitachi; Shoji Takeya, Tokai-mura; Toru Miyasaka; Kazushige Oonishi, both of Hitachi, all of Japan

[73] Assignee: Hitachi, Ltd., Tokyo, Japan

[21] Appl. No.: 09/127,970

[22] Filed: Aug. 3, 1998

[30] Foreign Application Priority Data

Aug. 4, 1997 [JP] Japan ..... 9-208967

[51] Int. Cl.[7] ..... G03G 15/04

[52] U.S. Cl. ..... 399/119

[58] Field of Search ..... 399/284, 279, 399/119, 222, 162

[56] References Cited

U.S. PATENT DOCUMENTS

| | | | |
|---|---|---|---|
| 5,612,769 | 3/1997 | Sugihara et al. | 399/119 |
| 5,666,599 | 9/1997 | Miyasaka et al. | 399/162 |
| 5,729,806 | 3/1998 | Niwano et al. | 399/284 |
| 5,839,034 | 11/1998 | Sato | 399/167 |
| 5,869,214 | 2/1999 | Anzai et al. | 430/47 |

FOREIGN PATENT DOCUMENTS 55-89869 7/1980 Japan .

1-309080 12/1989 Japan .

*Primary Examiner*—Arthur T. Grimley
*Assistant Examiner*—Greg Moldafsky
*Attorney, Agent, or Firm*—Anotnelli, Terry, Stout & Kraus, LLP

[57] ABSTRACT

A toner bearing body unit is constituted as one assembled unit including a toner bearing body for holding toners supplied from a toner supply roller of a housing main body at an outer peripheral surface thereof, a toner layer thickness regulating member for electrically charging the toners by applying pressure toward the outer peripheral surface of the toner bearing body and for forming a toner thin layer on the toner bearing body, and a holding member for holding the toner bearing body and the toner layer thickness regulating member. The toner bearing body unit is constituted to be directly attachable to and detachable from an outer side of the housing main body of a developing apparatus. Accordingly, an uniform toner thin layer having a predetermined thickness can be formed stably on the toner bearing body during a long period of use, and the developing apparatus reconstructed so that replacement of the components thereof can be carried out easily. Further a developing apparatus having a good recycling performance can be provided.

7 Claims, 3 Drawing Sheets

DEVELOPING APPARATUS AND IMAGE FORMING APPARATUS HAVING THE SAME

BACKGROUND OF THE INVENTION

The present invention relates to a developing apparatus in which toners supplied on a toner bearing body are formed as a developer agent layer having a predetermined thickness according to a toner layer thickness regulating member and an electrostatic latent image on a photoconductive body is visualized according to this developer agent layer and an image forming apparatus having the developing apparatus.

In a conventional developing apparatus, in generally a developing apparatus having a following constitution is known, namely a toner bearing body is supported rotatively by a housing of a developing apparatus and a toner layer thickness regulating member which is installed on this housing is opposed against the toner bearing body and further a toner thin layer is formed on the toner bearing body according to this toner layer thickness regulating member.

Further, the toner layer thickness regulating member is constituted by a plate shape holding member in which a friction regulating member such as a rubber plate is installed at a tip end thereof and this holding member is installed to screw holes of the housing through screw members and then the rubber plate being served as the friction regulating member is contacted to the toner bearing body.

Further, as disclosed in Japanese patent laid-open publication No. Hei 1-309080, a developing apparatus is constituted in which a toner bearing body is supported rotatively to a housing by a supporting shaft and making the supporting shaft as a standard a toner layer thickness member is positioned.

Further, as disclosed in Japanese patent laid-open publication No. Sho 55-89869, a developing apparatus is constituted in which a mechanism for interconnected supporting a toner bearing body and a toner layer thickness regulating member is provided, and by regulating the coefficients in linear expansion of these components a positioning accuracy is improved.

In the above stated conventional techniques, it is devised to aim to position accurately the toner bearing body and the toner layer thickness regulating member and to form uniformly the toner thin layer. Recently, an uniformity performance about an image quality is requested to obtain a high quality performance and also a high precision performance.

So as to obtain the above the uniformity in the image quality, a further high accurate positioning between the toner bearing body and the toner layer thickness regulating member is required.

Further, in the conventional techniques, to regulate a distance between the toner bearing body and the toner layer thickness regulating member, by providing a supporting plate etc. the above distance regulation is carried out, however they are fixed to the housing and are formed as a final embodiment.

In the above stated case, by an affect of the accuracy in the housing and an error in the installation, a twist etc. occur, accordingly there is a case in which the high accuracy positioning is obstructed.

Further, in the toner bearing body and the friction regulating member of the toner layer thickness regulating member, even there is only the inconvenience of the above stated positioning accuracy but also the extremely fine surface defects (the defects having 20–100 $\mu$m), in the high precision image a clear image inconvenience occurs.

Accordingly, there is an afraid in which in a mass production process a failure article mixes into.

In the above stated case, it is desirable to exchange easily the toner bearing body and the toner layer thickness regulating member.

Further, in the developing apparatus the toners being fine powder bodies are enclosed in the housing and it is difficult to mend the developing apparatus during a generation of the inconvenience. According to the circumstances there is a case in which it is necessary to carry out a disposal of the developing apparatus main body.

Further, recently a require for a recycling is heightened and then it is necessary to consider the recycling of an used article.

Herein, it is preferable to reuse the toners only through the repackaging of the toners, but in accordance with the treatment after the use, during the recovery and several times recycling etc., there is an afraid in which it is impossible to carry out the recycling because that the toner bearing body and the toner layer thickness regulating member are damaged and are worn out.

SUMMARY OF THE INVENTION

An object of the present invention is to provide a developing apparatus wherein an uniform toner thin layer having a predetermined thickness can be formed stably on a toner bearing body during a long period and an exchange of a component can be carried out easily and further a recycle can be performed and an image forming apparatus having the developing apparatus.

A characteristic according to the present invention is that a toner bearing body unit comprises as one body by a toner bearing body for holding the toners supplied from a toner supply roller at an outer puerperal surface thereof, a toner layer thickness regulating member for tribo-electric charging the toners by pressing under pressure to the outer peripheral surface of the toner bearing body and for forming a toner thin layer on the toner bearing body, and a holding member for holding the toner bearing body and the toner layer thickness regulating member.

Further, another characteristic according to the present invention is that the toner bearing body unit is constituted to attach to and detach from an outer side of a housing main body of the developing apparatus.

Further, a further characteristic according to the present invention is that the toner layer thickness is maintained $0.42\pm0.03$ mg/cm$^2$, and a toner electric charging amount of the toners is maintained continuously 20–30 $\mu$C/g.

DETAILED DESCRIPTION OF THE INVENTION

Hereinafter, one embodiment of a developing apparatus according to the present invention and an image forming apparatus having the developing apparatus according to the present invention will be explained referring to drawings.

Figure 1:
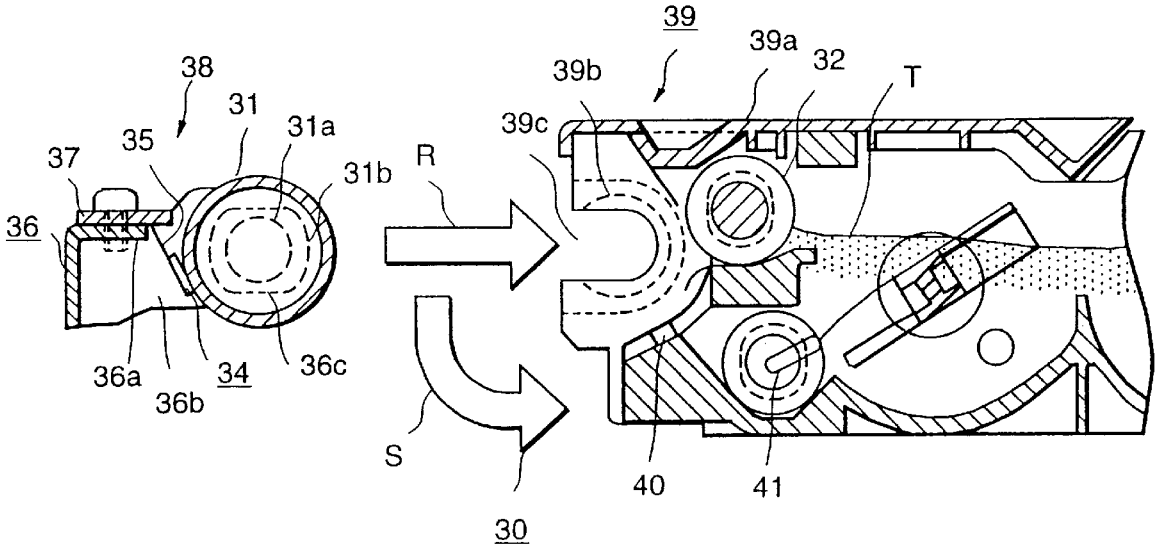
FIG. 1 is a longitudinal cross-sectional view showing one embodiment of a developing apparatus according to the present invention and a view showing a condition in which before a toner bearing body unit is installed to the developing apparatus.
Figure 2:
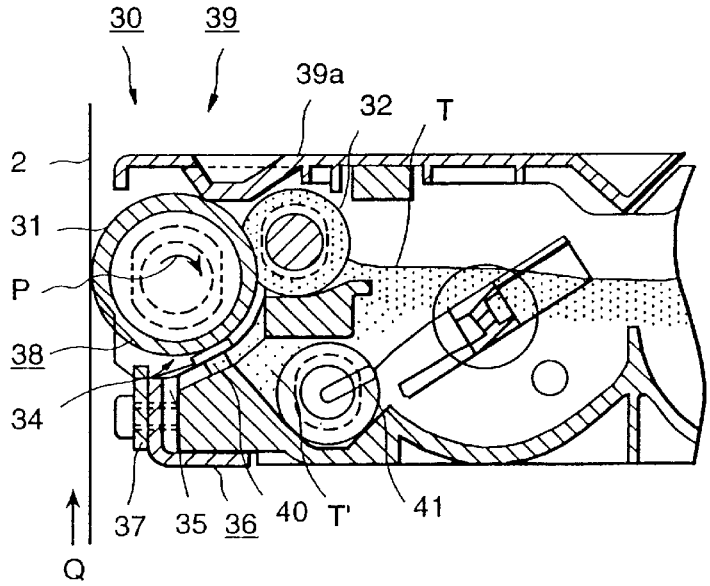
FIG. 2 is a longitudinal cross-sectional view showing a condition in which after the toner bearing body unit is installed to the developing apparatus.

FIG. 1 and FIG. 2 show a constitution of one embodiment of a developing apparatus according to the present invention, respectively.

FIG. 1 shows a condition in which before a toner bearing body unit is installed to the developing apparatus and FIG. 2 shows a condition in which after the toner bearing body unit is installed to the developing apparatus, respectively.

As shown in FIG. 1 and FIG. 2, a developing apparatus 30 is classified roughly and is comprised of a housing main body 39 and a toner bearing body unit 38.

The toner bearing body unit 38 is comprised of a toner bearing body 31, a toner layer thickness regulating member 34, a holding member for holding the toner bearing body 31 and the toner layer thickness regulating member 34, and a pushing plate 37 for fixing the toner layer thickness regulating member 34 to the holding member 36.

A toner bearing body supporting shaft 31*a* of the toner bearing body 31 is engaged with an opening portion 36*c* of a supporting portion 36*b* through a bearing member 31*b* and then the toner bearing body 31 is held on the supporting portions 36 which are provided on both sides of the holding member 36. Further, as a material of the toner bearing body 31, a conducting body such as an aluminum, a stainless steel or a conducting rubber is employed.

The toner layer thickness regulating member 34 is comprised of a pressuring means 35 and a friction regulating member 34*a*, and the pressuring means 35 is fixed to the pressing plate 37 by sandwiching a holding portion 36*a* of the holding member 36.

And the toner layer thickness regulating member 34 pressurizes the toner bearing body 31 through the friction regulating member 34*a* by a suitable pressure force according to the pressurizing means 35.

Further, the pressurizing means 35 is constituted by a leaf spring member of a thin leaf plate such as a stainless steel and a phosphorus bronze etc.

The friction regulating material 34*a* is formed by a rubber plate (urethane rubber, silicon rubber etc.) and is stuck on the leaf rubber member of the pressurizing means 35.

Further, by extending the leaf spring member of the pressurizing member the leaf spring member can be contacted directly to the toner bearing body 31. Herein, it is preferable to constitute the holding member 36 and the supporting portion 36 by one body component, however it can be constituted by assembling other components.

Further, to prevent a deformation due to an affect of a difference in coefficients in linear expansion between the materials of the holding member 36 and the supporting portion 36*b* and the material of the pressurizing means 35 of the toner layer thickness regulating member 34, it is desirable to constitute the materials of the holding member 36 and the supporting portion 36*b* using a metal plate, such a metal plate has an extremely small difference in the coefficient in linear expansion.

The housing main body 39 is constituted by a toner supply roller 32 for supplying toners T to the toner bearing body 31 of the toner bearing body unit 38, a toner sealing member 40 provided on a position corresponding a rear face position of the toner layer thickness regulating member 34, a toner scratching-out member 31 for scratching out a superfluous toner T' (a supply superfluous part) which is left in accordance with a regulation of a layer thickness through the toner layer thickness regulating member 34, and a housing 39*a* for receiving the toners T, the toner supply roller 32, the toner sealing member 40, the toner scratching-out member 41, etc.

On the housing 39 of the housing main body 39, an opening portion 39 is provided in such a manner in which the bearing member 31*b* of the toner bearing body unit 38 can be installed attachably to and detachably from easily the supporting portion 39*b* at a side of the housing 39*a*.

Accordingly, the toner bearing body unit 38 being formed as one body is constituted attachably to and detachably from the housing 39*a*.

With the above stated construction, the toner bearing body unit 38 is installed attachably and detachably easily without a take-off a cover (not shown in figure) of the housing 39*a*.

By inserting the toner bearing body unit 38 in an arrow mark R direction shown in FIG. 1 and further rotating the toner bearing body unit 38 in an arrow mark S direction, as shown in FIG. 2 the toner bearing body unit 38 can be installed to the housing main body 39.

After the toner bearing body unit 38 has installed, a photoconductive belt 2 is driven from a lower portion to an upper portion in an arrow mark Q direction and the toner bearing body 31 of the toner bearing body unit 38 is contacted to or is maintained a gap having 0.1–0.3 mm to the photoconductive belt 2 and is rotated and driven in an arrow mark P direction.

Figure 3:
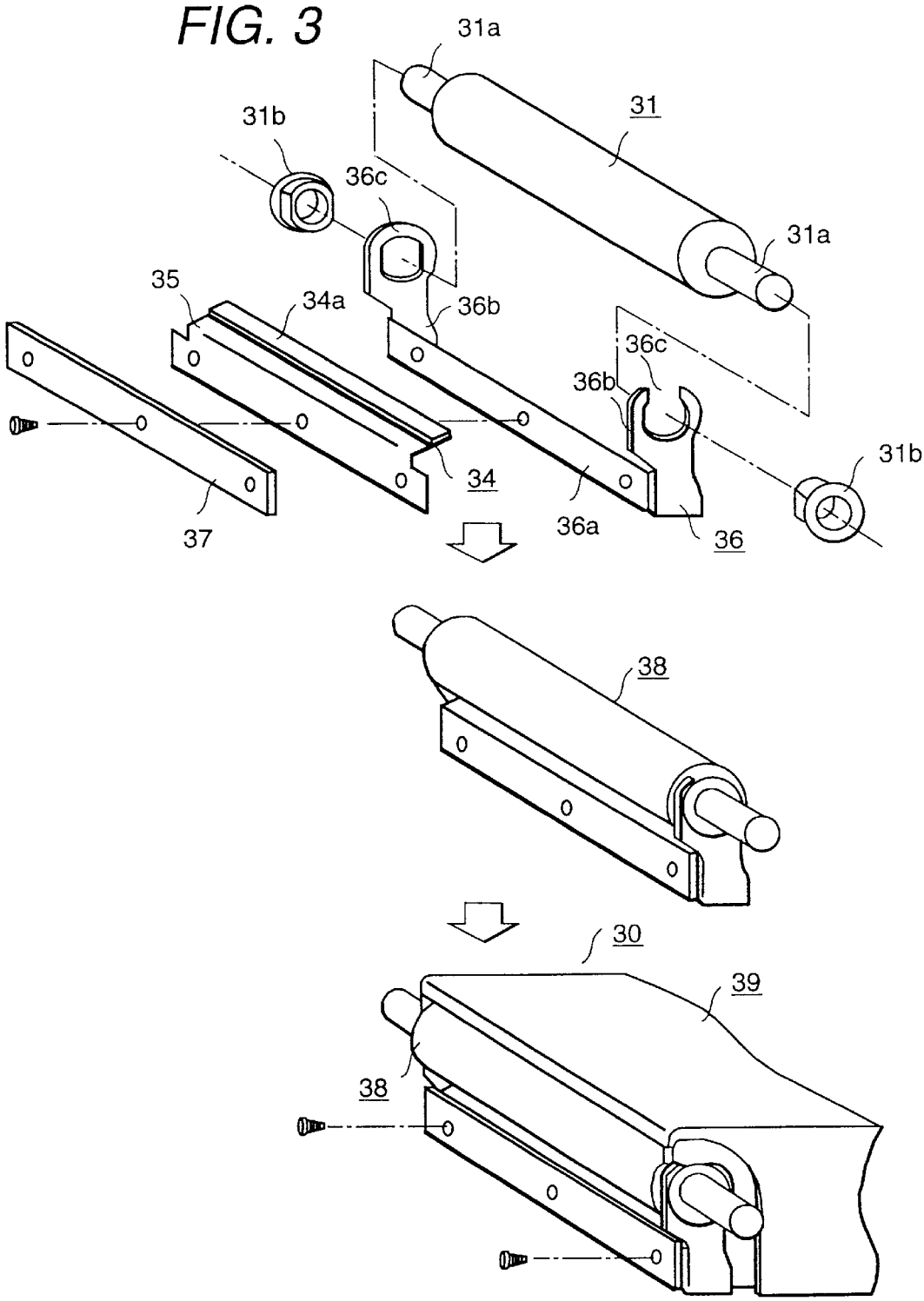
FIG. 3 is a squint view showing an assembling and a constitution of the toner bearing body unit of the developing apparatus.

FIG. 3 is a squint view showing an assembling and a constitution of the toner bearing body unit 38 in detail.

As stated in the above, the toner layer thickness regulating member 34 is sandwiched to the holding portion 36*b* of the holding member 36 by the pressing plate 37 and fixed through the screw members and further the toner bearing body supporting shaft 31*a* of the toner bearing body 31 is engaged with both side supporting portions 36*b* through the bearing member 31*b*, as a result the toner bearing body unit 38 is constituted.

This toner bearing body unit 38, as shown in FIG. 1, is inserted in the arrow mark P direction by aligning a flat plane portion of the bearing member 31 to the opening portion 39*c* of the housing 39*a* and is rotated in an arrow mark S direction. Therefore, the supporting portion 39*b* of the housing 39 is engaged with a cylindrical portion of the housing 39*b* and finally using the screw members the toner bearing body unit 31 is fastened and fixed to the housing 39*a*, as a result a final embodiment of the developing apparatus 30 is completed.

Further, as stated in the above, when the toner bearing body unit 38 is installed, the toner sealing member 40 is provided on the housing 39*a* at a position corresponding the a rear face position of the toner layer thickness regulating member 34.

The toner sealing member 40 is constituted by an elastic member such as an urethane foam sponge plate or a rubber plate, etc. or a sheet shape thin plate.

Further, in the housing 39*a*, the toner scratching-out member 41 is provided and then a prevention of a toner stagnation at a peripheral portion of the toner layer thickness regulating member 34 can be attained.

Next, an operation of the developing apparatus 30 having the above stated construction will be explained.

Against to the toner bearing body 31, the toner supply roller 32 for enable to rotate and contact is arranged at a back portion of the toner bearing body 31. The toners T which are adhered to the toner supply roller 32 are adhered to the toner bearing body 31 and the toners T are supplied to the toner bearing body 31.

In accordance with the pressurizing member 35 for adding the contact pressure against to the toner bearing body 31, a toner thin layer is formed according to the friction regulating member 34*a* of the toner layer thickness regulating member 34 which has pressurized to have a predetermined pressure.

Herein, the superfluous toners T' (the supply superfluous part) which are left by regulating the layer thickness according to the toner layer thickness regulating member 34 are fallen down to a lower portion of the layer regulating member 34*a*.

After that, the supply superfluous toners T' are scratched out by the rotative toner scratching-out member 41 and since the stagnant of the superfluous toners T' does not occur at the peripheral portion of the toner layer thickness regulating member 34, accordingly the all times stable toner layer formation can be carried out and a suitable electric charging to the toners can be attained.

In a printing test about 10000 sheets according to the developing apparatus 30 of the present invention, a toner layer thickness is maintained 0.42±0.03 mg/cm$^2$, and a toner electric charging amount is maintained 20–30 $\mu$C/g and as a result a long period stability performance can be attained.

Further, since the toner bearing body 31 and the toner layer thickness regulating member 24 are made as one body by the holding member 36, in a case where a component accuracy of the holding member 36 is managed to make a high accuracy and then an accurate positioning between the toner bearing body 31 and the toner layer thickness regulating member 34 can be attained and further a stable and uniform toner thin layer formation can be attained. As a result, an uniformity performance of the image can be improved and a high quality performance and a high precision performance can be realized.

Further, since the toner bearing body 31 and the toner layer thickness regulating member 34 are made as one body by the holding member 36, the positioning between the toner bearing body 31 and the toner layer thickness regulating member 34 is determined by the holding member 36. As a result, for the positioning a high accuracy in the housing 39*a* is not required, further a twist etc. according to the error in the installation during the assembling hardly occur.

On the other hand, according to the conventional techniques stated in the above, the positioning between the toner bearing body and the toner layer thickness regulating member according to the housing and a high accuracy of the housing is required. Accordingly, it is necessary to use a high cost resin to enable for the high accuracy molding and further an accurate positioning is carried out by using a jig tool etc. during the assembling working.

However, in this embodiment according to the present invention, using a general resin material, a necessary and a full accuracy can be obtained, further during the assembling working the holding member 36 as a single component can be sufficient to carry out a high accuracy manage, as a result a shorting performance in an assembling time can be attained and a low cost structure can be realized.

Further, in this embodiment according to the present invention, an integrated toner bearing body unit 38 is constituted attachably to and detachably from freely the housing main body 39, further the toner bearing body unit 38 is constituted attachably to and detachably from freely without the removal of the cover of the housing 39*a*.

As a result, in a case where an extremely fine surface defects (the defects of 20–100 $\mu$m are existed) in the toner bearing body 31 and the friction regulating member 34*a* of the toner bearing body unit 38, since the toner bearing body unit 38 can be attached to and detached from simply, a detection of an existence of an image defect can be performed and then a discovery of a failure article can be carried out.

On the other hand, according to the conventional techniques stated in the above, since the detection of the existence of the image defect is performed until the final embodiment has completed, in a case where the above stated extremely fine surface defects are existed, it is necessary to mend after the removal of the cover of the housing of the developing apparatus or in a case where the above case is difficult it is necessary to carry out the disposal of the main body of the developing apparatus.

However, in this embodiment according to the present invention, the toner bearing body unit 34 and components other than the toner bearing body unit 38 are assembled separately and at the final time by assembling only the good articles and the final embodiment is formed. Accordingly, the mixing of the failure article can be prevented and only the good article can be obtained in accordance with the mass production.

Further, at the worst in a case where the failure article is discovered at the final embodiment for some cause, in this embodiment according to the present invention, without the removal of the cover of the housing 39*a* it is sufficient to exchange only the toner bearing body unit 38.

Further, during the recycling the device, in which the toners enclosed in the developing apparatus 30 have used and have run short, is recovered and reused.

However, after the use the developing apparatus 30 is thrown into confusion and further during the recovery transportation the developing apparatus 30 is strike to some member. In this case there are cases in which the toner bearing body 31 and the toner layer thickness regulating member 34 of the toner bearing body unit 38, which are the most precise portion of the developing apparatus 30, may be damaged and destroyed.

In the above stated cases, by removing only the toner bearing body unit 38, a maintenance can be carried out simply.

Further, according to some times recycling, it is considered that the toner bearing body 31 and the toner layer thickness regulating member 34 reach to the life, however in this case it can exchange only the toner bearing body unit 38, the recycling can be carried out by enclosing new toners in the developing apparatus 30.

Figure 4:
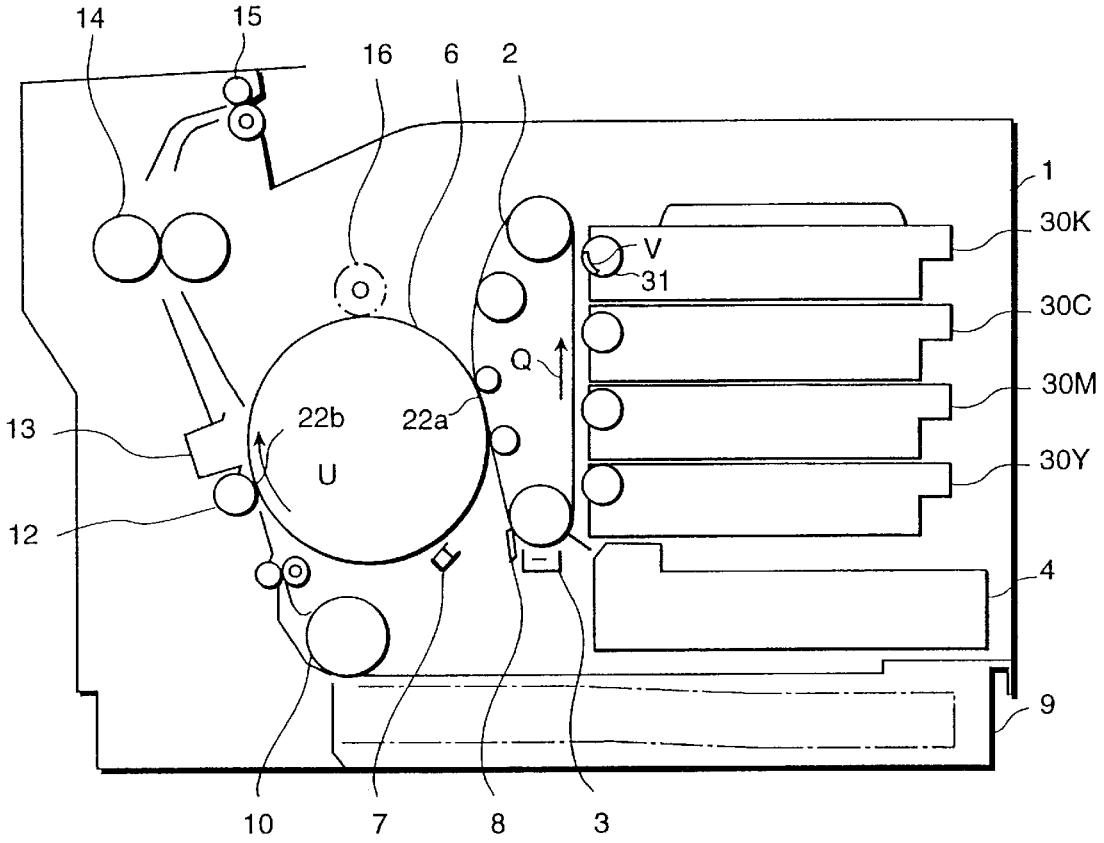
FIG. 4 is a view showing a constitution of a small size color image forming apparatus having the developing apparatus of one embodiment according to the present invention.

FIG. 4 shows a constitution of a compact type color image forming apparatus having the development apparatus of the one embodiment according to the present invention.

As shown in FIG. 4, in this color image forming apparatus a photoconductive belt 2 being a latent image holding means is installed lengthily toward a vertical direction in a main body of the apparatus which is constituted by an apparatus frame body (an outer frame) 1.

And, making the photoconductive belt 2 as a boundary, at a left side in the figure a transfer drum 6 being an intermediate transfer body, a transfer apparatus 12, a supply apparatus 10 of a recording medium, a fixing means 14 are arranged, on the other hand at a right side in the figure developing apparatuses 30Y, 30M, 30C and 30K, in which toners having a different color of four colors are filled up respectively, are arranged.

At a lower portion of the developing apparatus 30Y, an exposing apparatus 4 for forming the latent image to the photoconductive belt 2 is arranged, further at a lower portion of the exposing apparatus 4 a paper feeding cassette 9 for accommodating the recording medium is arranged.

At a peripheral portion of the transfer drum 6, a transfer apparatus 12, an intermediate transfer body cleaning apparatus 16 are arranged, and at a peripheral portion of the photoconductive belt 2, an electric charging apparatus 3, a residue image removing apparatus 7, a photoconductive body cleaning apparatus 8 are arranged.

The photoconductive belt 2 being the latent image holding means is driven toward an arrow mark Q direction by a driving apparatus (not shown).

And, at first a photoconductive layer of a surface of the driven photoconductive belt 2 is electrical charged uniformly by the electric charging apparatus 3.

Next, by the exposing apparatus 4, an image and a character information according to a personal computer, an image scanner etc. are exposed with a dot unit and an electrostatic latent image is formed on the photoconductive belt 2.

After that, the electrostatic latent image on the photoconductive belt 2 is developed by either of the developing apparatuses 30Y, 30M, 30C, and 30K and the electrostatic latent image is visualized as a toner image and the visualized image is sent into a first transfer position 22*a*.

The photoconductive belt 2 is given the potential by a power supply (not shown) and the transfer drum 6 is connected to a ground.

Accordingly, at the first transfer position 22*a*, according to these potential differences a transfer of the toner image from the photoconductive belt 2 to the transfer drum 6 is carried out.

After the photoconductive belt 2 has passed through the first transfer position 22*a*, on the photoconductive belt 2 the electrostatic latent image is erased by a light irradiation according to the residual image erasing apparatus 7, a surface potential of the photoconductive belt 2 is fallen down less than a predetermined level.

After that residual toners on the photoconductive belt 2 which are left not by transferring by the first transfer are cleaned according to the photoconductive body cleaning apparatus 8, and then the apparatus is possible to carry out a next toner image formation.

The one cycle operation stated in the above is carried out successively against the developing apparatuses 30Y, 30M, 30C, and 30K by suiting one rotation timing of the transfer drum 6 and a plural color toner image is formed on the transfer drum 6 by overlapping a single color toner image.

On the other hand, the recording medium such as a paper and OHP sheet, etc. is supplied from the supplying apparatus 10 to a second transfer position 22*b* by taking a timing and thus the single color toner image or the plural color toner image formed on the transfer drum 6 is transferred to the recording medium according to the action of the transfer apparatus 12.

After the toners have transferred to the recording medium, the recording medium is peeled off from the transfer drum 6 according to a recording medium peeling-off apparatus 13 and the toners are fused and fixed according to the fixing means 14, and the recording medium is discharged from on an upper face of the main body of the apparatus according to a paper discharging apparatus 15.

On the other hand, after the transfer finish to the recording medium, the residual toners which are not transferred and left on the transfer drum 6 are cleaned according to the intermediate transfer body cleaning apparatus 16 and the apparatus becomes enable to carry out a next toner image overlapping.

Since the transportation route from the paper supply to the paper to the discharging of the recording medium is simplified as possible and a curvature radius of the transportation route is formed large, a paper stacking on a midway of during the transportation can be prevented and a reliability performance can be improved.

Further, a treatment of during the paper stacking can be carried out simply and further the apparatus can be corresponded with the various kinds recording mediums such a thick paper etc.

In this embodiment according to the present invention, since the recording medium transportation route is arranged with a substantially circular arc shape and further since the transfer drum 6, the photoconductive belt 2, the developing apparatuses 30Y, 30M, 30C and 30K, the exposing apparatus 4 etc. are arranged at an inner side of the recording medium transportation route, a space can be utilized validly and the main body of the apparatus can be formed the small scale and the during the discharging of the recording medium the recording medium can be discharged by making a printing face in a lower direction.

With the above stated arrangement, the transportation route can be simplified, also since almost units are arranged at the inner side of the main body of the apparatus than the transportation route, the transportation route is arranged at a vicinity of the apparatus frame body (the outer frame) 1 and is opened easily from an outer side, the treatment during the paper stacking can be carried out simply.

Further, since the recording medium during the paper discharging is discharged by making the printing face in the lower direction, the recording medium can be discharged by arranging the printing order from the side of the printing face.

Since the photoconductive body is constituted by a belt shape structure, the plural color developing apparatuses 30 are arranged with the substantially same shape and in the same plane to the photoconductive belt, by suiting the color to be developed a mechanism for exchanging over the developing apparatus 30 and a structure for alternating the shape of the developing apparatus every color each are not necessary to install, a compact type and a low cost apparatus can be obtained.

Further, by arranging lengthily the photoconductive belt 2 in the vertical direction, since the space for occupying the photoconductive belt in the same puerperal length can be formed small, accordingly the main body of the apparatus can be formed with the small scale.

Further, in a case where the recording medium is transported directing toward to the upper portion from the lower portion of the main body of the apparatus, since the transfer drum 6 is rotated in an arrow mark U direction and the photoconductive belt 2 is rotated in an arrow mark Q direction. Since they are carried out the operation in an order direction at the respective contact portions, a construction having a high developing efficiency of the apparatus can be obtained, and further a construction having a small number of problems about a vibration etc. can be obtained.

Further, since the transfer drum 6 is formed with a driven move form against the photoconductive belt 2, a construction having a small color share can be obtained.

In this time, since the toner bearing body 31 is constituted with a reversal developing system which is rotated in an arrow mark V direction (a system in which the toner bearing body is rotated from a lower portion to an upper portion at the photoconductive belt), the photoconductive belt 2 and the toner bearing body 31 can be operated in an order direction. As a result a construction having a high developing efficiency can be obtained and further a construction having a small number of problems about a vibration etc. can be obtained.

According to the present invention, since the toner bearing body unit is constituted with one body, the uniform toner thin layer having a predetermined thickness on the toner bearing body can be formed stably during a long period.

Further, the developing apparatus in which the exchange-over of the components can be carried out easily and the image forming apparatus having the above stated developing apparatus can be provided. As a result, a maintenance of a high quality performance and a high reliability performance in the developing apparatus and an improvement of the recycling performance of the developing apparatus can be attained.

What is claimed is:

1. A developing apparatus having a housing main body, a toner supply roller for supplying toner in the form of fine coloring powder bodies accommodated in said housing main body, and an opening portion provided in said housing main body; and a toner bearing body unit for forming said toner supplied from said toner roller into a toner layer, said toner layer to be applied to a latent image holding means on which an electrostatic latent image is to be developed, wherein said toner bearing body unit is constituted as one body, including:

a cylindrical toner bearing body on a support shaft for receiving and holding toner supplied from said toner supply roller on an outer peripheral surface thereof;

bearing members slidingly engaging in the opening portion of said housing main body and rotatably supporting said toner bearing body support shaft;

a toner layer thickness regulating member for charging said toner by pressing the toner on said outer peripheral surface of said toner bearing body so as to form a toner thin layer on said toner bearing body; and a holding member for holding said toner bearing body and said toner layer thickness regulating member, said holding member being securable to said housing main body.

2. A developing apparatus according to claim 1, wherein said holding member positions said toner bearing body so as to maintain a predetermined interval between an axis of said toner supply roller and an axis of said toner bearing body when said holding member is secured to said housing main body.

3. A developing apparatus according to claim 1, wherein said holding member is mounted on said bearing members, so as to be rotatable about the axis of said toner bearing body support shaft, and is secured so as to be attachable to and detachable from said housing main body.

4. A developing apparatus according to claim 1, wherein said toner bearing body unit is configured so as to be directly attachable to and detachable from an outer side of said housing main body, so that said toner bearing body unit may be mounted on or removed from said housing main body by sliding said bearing members in or out of said opening portion.

5. A developing apparatus according to claim 1, wherein a toner electric charging amount of said toner is set at 20–30 $\mu$C/g.

6. A developing apparatus according to claim 1, wherein said thin toner layer is set at $0.42 \pm 0.03$ mg/cm$^2$.

7. In an image forming apparatus in which plural developing apparatuses for accommodating respective toners corresponding to respective colors are arranged at a peripheral portion of a photoconductive body, wherein by rotating said photoconductive body through at least one rotation, plural latent images corresponding to a respective color are formed on said photoconductive body and said plural latent images are developed by said plural developing apparatuses, and a toner image having plural colors is formed on said photoconductive body, wherein each of said developing apparatuses comprises:

a housing main body, a toner supply roll for supplying toner in the form of fine coloring powder bodies accommodated in said housing main body, and an opening portion provided in said housing main body; and a toner bearing body unit constituted so as to be attachable to and detachable from said housing main body on an outer side of said housing main body and for forming a thin layer of toner to be applied to said photoconductive body on which an electrostatic latent image is to be developed, wherein said toner bearing body unit is constituted as one body, including:

a cylindrical toner bearing body on a support shaft for receiving and holding toner supplied from said toner supply roller on an outer peripheral surface thereof;

bearing members slidingly engaging in the opening portion of said housing main body and rotatably supporting said toner bearing body support shaft;

a toner layer thickness regulating member to form a toner thin layer on said toner bearing body; and a holding member for holding said toner bearing body and said toner layer thickness regulating member, said holding member being secured to said housing main body; and wherein said photoconductive body is provided with a belt shape, and each of said developing apparatuses has substantially the same shape and is arranged in the same plane of said photoconductive body.

* * * * *